US005823167A

United States Patent [19]

Fukuchi et al.

[11] Patent Number: 5,823,167

[45] Date of Patent: Oct. 20, 1998

[54] CONTROL SYSTEM FOR INTERNAL COMBUSTION ENGINES

[75] Inventors: Hironao Fukuchi; Takanori Shiina; Kenji Nakano; Katsuhiro Kumagai; Yoshihisa Hara, all of Wako, Japan

[73] Assignee: Honda Giken Kogyo Kabushiki Kaisha, Tokyo, Japan

[21] Appl. No.: 812,881

[22] Filed: Mar. 6, 1997

[30] Foreign Application Priority Data

Mar. 7, 1996 [JP] Japan ..... 8-078089

[51] Int. Cl.[6] ..... F02P 5/14

[52] U.S. Cl. ..... 723/421

[58] Field of Search ..... 123/421, 579 R, 123/435, 425

[56] References Cited

U.S. PATENT DOCUMENTS 4,856,481 8/1989 Kamise et al. ..... 123/425
4,864,103 9/1989 Bishop et al. ..... 123/519 R
5,027,771 7/1991 Daikoku et al. ..... 123/421
5,309,882 5/1994 Hoshiba et al. ..... 123/421
5,398,660 3/1995 Koyama et al. ..... 123/519
5,477,842 12/1995 Maruyama et al. ..... 123/690
5,483,935 1/1996 Ogawa et al. ..... 123/421

*Primary Examiner*—Raymond A. Nelli
*Attorney, Agent, or Firm*—Nikaido, Marmelstein, Murray & Oram LLP

[57] ABSTRACT

A control system for an internal combustion engine has a canister for adsorbing evaporative fuel generated in the fuel tank, a purging passage extending between the canister and the intake system of the engine, for purging evaporative fuel into the intake system, and a purge control valve arranged across the purging passage, for controlling the flow rate of evaporative fuel supplied to the intake system through the purging passage. An ECU controls the engine, based on at least one predetermined engine control parameter, and a canister temperature sensor detects the temperature of the canister. The at least one predetermined engine control parameter is changed according to the detected temperature of the canister.

11 Claims, 5 Drawing Sheets

CONTROL SYSTEM FOR INTERNAL COMBUSTION ENGINES

BACKGROUND OF THE INVENTION

1. Field of the Invention

This invention relates to a control system for internal combustion engines, and more particularly to a control system of this kind, which is provided with an evaporative fuel-processing system which stores in a canister evaporative fuel generated in the fuel tank and supplies evaporative fuel into the intake system of the engine when it is required.

2. Prior Art

Under the conventional emission regulations of HC (hydrocarbon) compounds present in exhaust gases emitted from internal combustion engines, either the regulation of total emission of HC compounds or the regulation of total emission of NMHC (Non-Methane Hydrocarbon: HC compounds excluding methane and oxygenated HC compounds) is demanded. Therefore, the conventional regulations can be satisfied by reducing the total emission of HC compounds. To reduce the total emission of HC compounds, various methods of improving the combustion state of an internal combustion engine have been proposed, which include a method of increasing the combustion speed of the mixture by forming a swirl in the combustion chamber, a method of improving the atomization of fuel, and a method of controlling an amount of exhaust gases to be recirculated or the ignition timing so as to reduce the total amount of emission of HC compounds.

However, a new regulation, i.e. California Low-Emission Vehicle (LEV) Regulation which will come into force in the near future targets reduction of the amount of NMOG (Non-Methane Organic Gas: NMHC and oxygenated HC compounds (aldehydes/ketones and alcohols/ethers). Therefore, the conventional methods of improving the combustion state of the engine cannot fully satisfy the new regulation. That is, the conventional methods cannot reduce HC compounds (aldehydes, ketones, etc.), which produce ozone by a photochemical reaction with NOx under the sunlight. On the contrary, the conventional methods can increase alkene components which are likely to produce ozone.

SUMMARY OF THE INVENTION

It is the object of the invention to provide a control system for internal combustion engines, which is capable of reducing the amount of emission of components which are likely to produce ozone, by properly controlling the engine.

To attain the above object, the present invention provides a control system for an internal combustion engine having a control system for an internal combustion engine having an intake system, a fuel tank, a canister for adsorbing evaporative fuel generated in the fuel tank, a purging passage extending between the canister and the intake system, for purging evaporative fuel into the intake system, and a purge control valve arranged across the purging passage, for controlling a flow rate of evaporative fuel supplied to the intake system through the purging passage;

the control system comprising:

engine control means for controlling the engine, based on at least one predetermined engine control parameter;

canister temperature-detecting means for detecting temperature of the canister; and parameter-changing means for changing the at least one predetermined engine control parameter according to the temperature of the canister detected by the canister temperature-detecting means.

Preferably, the at least one predetermined engine control parameter includes a control amount of ignition timing of the engine.

More preferably, the parameter-changing means advances the ignition timing of the engine as the temperature of the canister detected by the canister temperature-detecting means is higher.

Also preferably, the at least one predetermined engine control parameter includes an amount of exhaust gases to be recirculated.

More preferably, the parameter-changing means increases the amount of exhaust gases to be recirculated as the temperature of the canister detected by the canister temperature-detecting means is higher.

To attain the above object, the present invention also provides a control system for an internal combustion engine having an intake system, a fuel tank, a canister for adsorbing evaporative fuel generated in the fuel tank, a purging passage extending between the canister and the intake system, for purging evaporative fuel into the intake system, and a purge control valve arranged across the purging passage, for controlling a flow rate of evaporative fuel supplied to the intake system through the purging passage;

the control system comprising:

engine control means for controlling the engine, based on at least one predetermined engine control parameter;

canister temperature-detecting means for detecting temperature of the canister;

canister heater means for heating the canister;

canister temperature control means for controlling the heater means such that the temperature of the canister assumes at least one specific temperature value, according to the temperature of the canister detected by the canister temperature-detecting means; and parameter-changing means for changing the at least one predetermined engine control parameter according to the temperature of the canister controlled by the canister temperature control means.

Preferably, the at least one specific temperature value is a temperature value at which a ratio of at least specific HC compound in the evaporative fuel becomes high, the at least one specific HC compound being likely to produce ozone.

The above and other objects, features, and advantages of the invention will be more apparent from the following detailed description taken in conjunction with the accompanying drawings.

DETAILED DESCRIPTION

The invention will now be described in detail with reference to the drawings showing an embodiment thereof.

Figure 1:
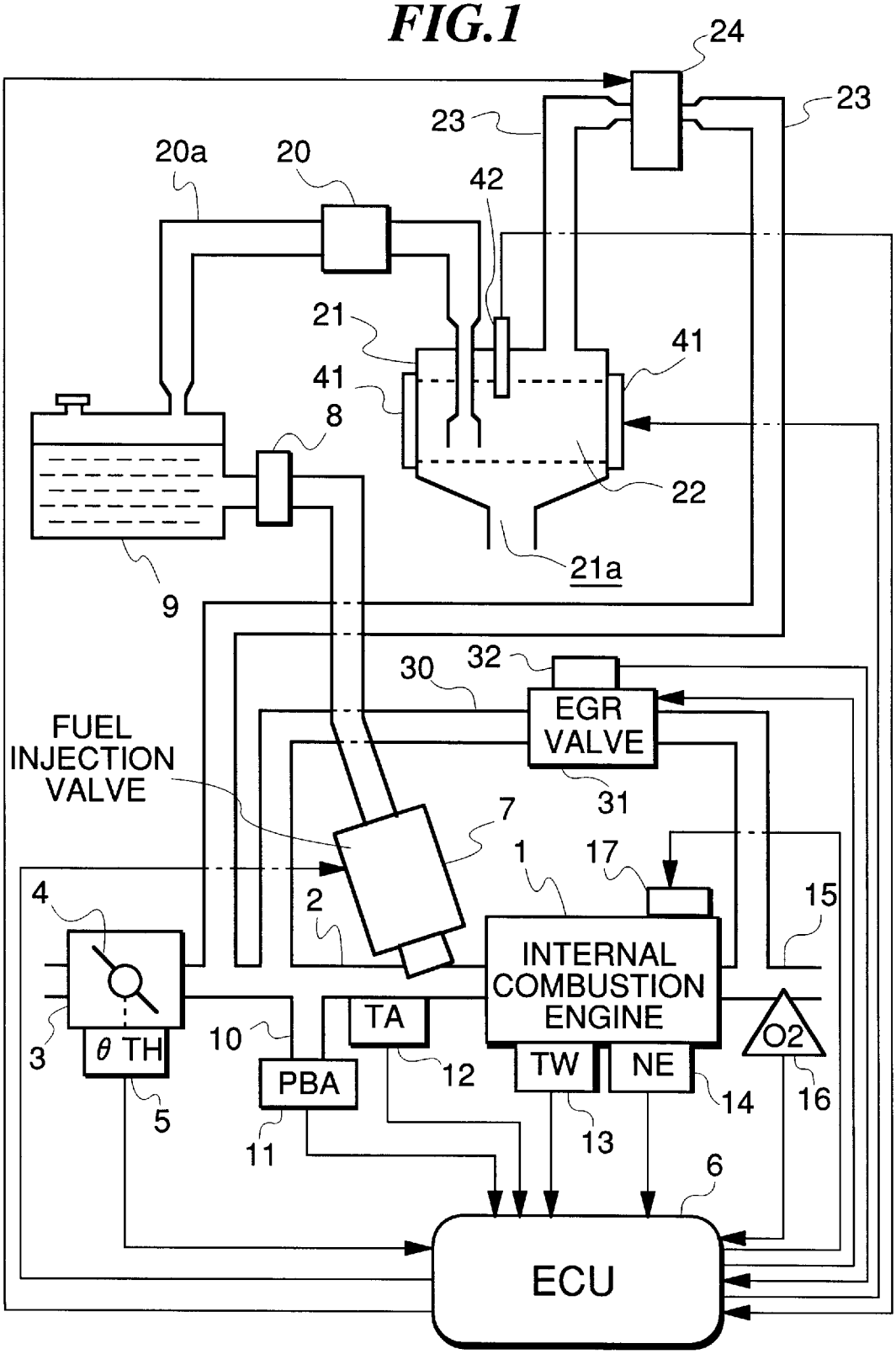
FIG. 1 is a block diagram schematically showing the whole arrangement of an internal combustion engine and a control system therefor, according to an embodiment of the invention.

Referring first to FIG. 1, there is illustrated the whole arrangement of an internal combustion engine and a control system therefor, according to an embodiment of the invention. In the figure, reference numeral 1 designates an internal combustion engine (hereinafter simply referred to as "the engine") having four cylinders, not shown, for instance. Connected to the cylinder block of the engine 1 is an intake pipe 2, across which is arranged a throttle body 3 accommodating a throttle valve 4 therein. A throttle valve opening (θ TH) sensor 5 is connected to the throttle valve 4, for generating an electric signal indicative of the sensed throttle valve opening θ TH and supplying the same to an electronic control unit (hereinafter referred to as "the ECU") 6.

Fuel injection valves 7, only one of which is shown, are inserted into the interior of the intake pipe 2 at locations intermediate between the cylinder block of the engine 1 and the throttle valve 4 and slightly upstream of respective intake valves, not shown. The fuel injection valves 7 are connected to a fuel tank 9 via a fuel pump 8. The fuel injection valves 7 are electrically connected to the ECU 6 to have their valve opening periods controlled by signals therefrom.

An intake pipe absolute pressure (PBA) sensor 11 is inserted into the intake pipe 2 at a location immediately downstream of the throttle valve 4 via a conduit 10, for supplying an electric signal indicative of the sensed intake pipe absolute pressure PBA to the ECU 6.

Further, an intake air temperature (TA) sensor 12 is arranged in the intake pipe 2 at a location downstream of the PBA sensor 11, for supplying an electric signal indicative of the sensed intake air temperature TA to the ECU 6. An engine coolant temperature (TW) sensor 13 formed of a thermistor or the like is inserted into a coolant passage formed in the cylinder block, for supplying an electric signal indicative of the sensed engine coolant temperature TW to the ECU 6.

An engine rotational speed (NE) sensor 14 is arranged in facing relation to a camshaft or a crankshaft of the engine 1, neither of which is shown. The NE sensor 14 generates a signal pulse as a TDC signal pulse at each of predetermined crank angles whenever the crankshaft rotates through 180 degrees, the TDC signal pulse being supplied to the ECU 6.

Each cylinder of the engine 1 has a spark plug 17 electrically connected to the ECU 6 to have its ignition timing θ IG controlled by a signal therefrom.

An O2 sensor 16 as an exhaust gas component concentration sensor is arranged in an exhaust pipe 15 of the engine 1, for detecting the concentration of oxygen present in exhaust gases, and generating a signal indicative of the sensed oxygen concentration to the ECU 6.

The fuel tank 9 which is hermetically sealed has an upper internal space thereof connected to the canister 21 via a passage 20*a*. The canister 21 communicates with the intake pipe 2 at a location downstream of the throttle valve 4, via a purging passage 23. The canister 21 accommodates therein an adsorbent 22 for adsorbing evaporative fuel generated in the fuel tank 9, and has an air inlet port 21*a*. Arranged across the passage 20*a* is a two-way valve 20 consisting of a positive pressure valve and a negative pressure valve. Further, arranged across the purging passage 23 is a purge control valve 24 which is a duty ratio control type electromagnetic valve. The purge control valve 24 has a solenoid thereof electrically connected to the ECU 6 to have a valve-opening period (valve-opening duty ratio) thereof controlled by a signal therefrom. The passage 20*a*, the two-way valve 20, the canister 21, the purging passage 23, and the purge control valve 24 collectively form an evaporative emission control system.

The canister 21 is provided with an electric heater 41 for electrically heating the canister 21, and a canister temperature sensor 42 for detecting the temperature TCAN of the canister 21 (more specifically, the adsorbent 22). The electric heater 41 and the canister temperature sensor 42 are electrically connected to the ECU 6. The canister temperature sensor 42 supplies an electric signal indicative of the sensed canister temperature TCAN to the ECU 6 which controls electric power to be supplied to the electric heater 41, based on the signal.

The evaporative emission control system operates such that evaporative fuel generated in the fuel tank 9 forcibly opens the positive pressure valve of the two-way valve 20 when the pressure thereof has reached a predetermined value, and then flows into the canister 21 to be adsorbed by the adsorbent 22 and stored in the canister 21. The purge control valve 24 is opened and closed in response to a duty ratio control signal from the ECU 6. While the valve 24 is open, evaporative fuel temporarily stored in the canister 21 is drawn through the purge control valve 24 into the intake pipe 21 together with fresh air introduced through the air inlet port 21*a*of the canister 21, due to negative pressure prevailing in the intake pipe 2, and then delivered to the cylinders. On the other hand, if negative pressure within the fuel tank 9 increases as the fuel tank 9 is cooled by fresh air, etc., the negative pressure valve of the two-way valve 20 is opened and hence evaporative fuel temporarily stored in the canister 21 is returned to the fuel tank 9. Thus, evaporative fuel generated in the fuel tank 9 is prevented from being emitted into the atmosphere.

An exhaust gas recirculation passage 30 extends from the intake pipe 2 at a location downstream of the throttle valve 4 to the exhaust pipe 15, across which is arranged an exhaust gas recirculation control (EGR) valve 31 for controlling an amount of exhaust gases to be recirculated (hereinafter referred to as "the EGR amount").

The EGR valve 31 is an electromagnetic valve having a solenoid which is electrically connected to the ECU 6 to have its valve opening controlled by a signal from the ECU 6. The EGR valve 31 is provided with a lift sensor 32 for detecting the opening of the EGR valve 31 and supplying an electric signal indicative of the sensed value to the ECU 6.

The ECU 6 determines operating conditions of the engine 1, based on engine operating parameter signals from various sensors including ones mentioned above, and supplies a control signal to the solenoid of the EGR valve 31 such that the difference between a valve opening command value LCMD for the EGR valve 31 and an actual valve opening LACT of the EGR valve 31 detected by lift sensor 31 becomes zero. The valve opening command value LCMD is determined based on the intake pipe absolute pressure PBA and the engine rotational speed NE.

The ECU 6 is comprised of an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), a memory circuit storing operational programs executed by the CPU and for storing results of calculations therefrom, etc., and an output circuit which outputs driving signals to the spark plugs 17, the fuel injection valves 7, the purge control valve 24, the EGR valve 31, and the electric heater 41.

The CPU of the ECU 6 operates in response to the above-mentioned various engine operating parameter signals from the various sensors to determine operating conditions in which the engine 1 is operating, and calculates, based upon the determined engine operating conditions, the ignition timing θ IG, the valve opening duty ratio of the purge control valve 24, the valve opening command value LCMD of the EGR valve 31, the valve opening period of the fuel injection valves 7, etc., to output driving signals for driving the spark plug 17, the EGR valve 31, the electric heater 41, etc., via the output circuit, based on results of the calculations.

More specifically, the valve-opening command value LCMD of the EGR valve 31 is calculated by the use of the following equation (1):

$$LCMD=LMAP+LCAN \quad (1)$$

where LMAP represents a map value calculated based on the engine rotational speed NE and the intake pipe absolute pressure PBA, and LCAN a correction term determined according to the detected canister temperature TCAN.

Further, the ignition timing θ IG (advance value) is calculated by the use of the following equation (2):

$$\theta IG=\theta IGMAP+\theta IGCAN+\theta IGCR \quad (2)$$

where θ IGMAP represents a basic value of the ignition timing θ IG determined according to the engine rotational speed NE and the intake pipe absolute pressure PBA, θ IGCAN a correction term determined according to the canister temperature TCAN, and θ IGCR a correction term determined according to the other engine operating parameters.

Figure 2:
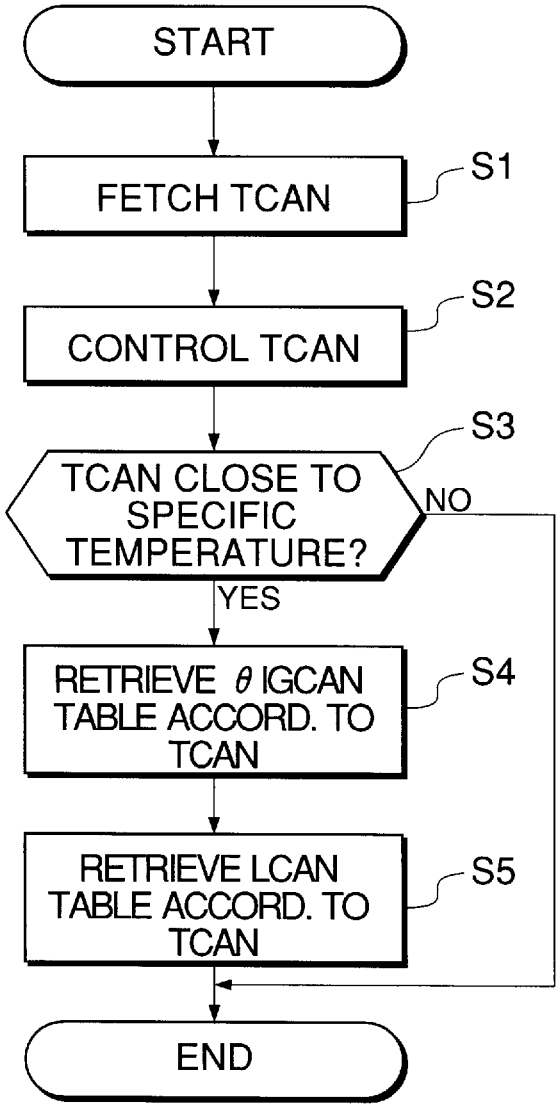
FIG. 2 is a flowchart showing a program for correcting ignition timing θ IG and an amount of exhaust gases to be recirculated.

FIG. 2 shows a program for calculating the correction term θ IGCAN of the ignition timing θ IG, and the correction term LCAN of the valve-opening command value LCMD, according to the canister temperature TCAN. This program is executed, for example, at predetermined time intervals.

First, at a step S1, the canister temperature TCAN detected by the canister temperature sensor 42 is fetched, and then at a step S2, canister temperature control is carried out. More specifically, the canister temperature TCAN is controlled to a value (hereinafter referred to as "the specific temperature") at which each of components of gasoline having large MIR values easily evaporates. MIR is an abbreviation for "Maximum Incremental Reactivity", i.e. a coefficient indicative of an ozone production contributive degree of each HC compound in gasoline. An HC compound having a larger MIR value is more likely to produce ozone).

Figure 3:
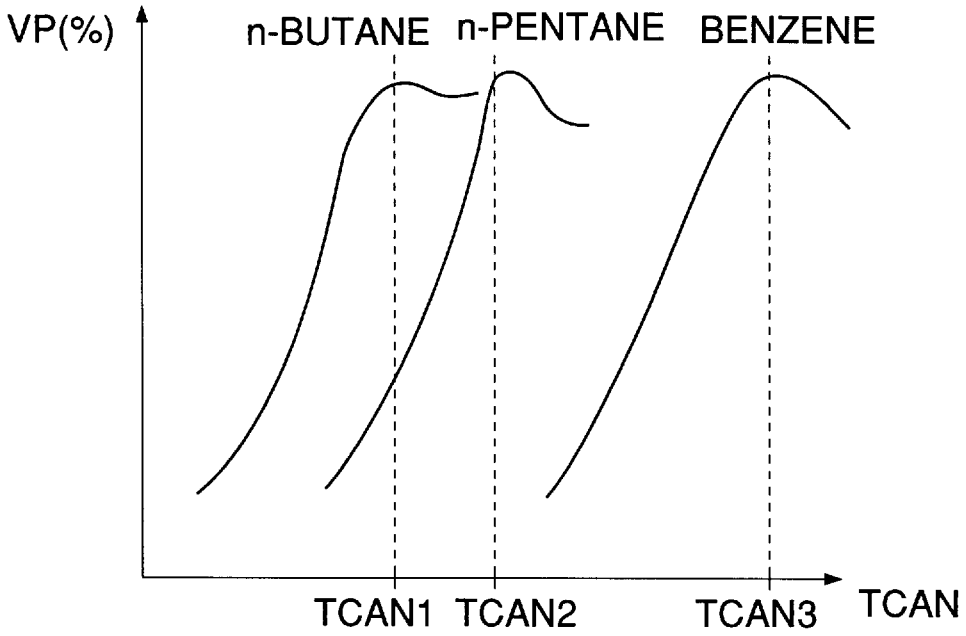
FIG. 3 is a graph showing the relationship between the temperature of a canister appearing in FIG. 1 and specific components of evaporative fuel.

FIG. 3 shows the relationship between specific temperatures TCAN1 (approx. 30° C.), TCAN2 (approx. 40° C.), and TCAN3 (approx. 80° C.), and components which easily evaporate at the respective temperatures, in which the ordinate indicates a ratio VP of a specific component in evaporative fuel. According to FIG. 3, the ratio of n-butane is the highest at the specific temperature TCAN1, the ratio of n-pentane at the specific temperature TCAN2, and the ratio of benzene at the specific temperature TCAN3. It is known that n-butane, n-pentane and benzene are HC compounds which have large MIR values.

If the detected canister temperature TCAN is lower than the first specific temperature TCAN1, energization of the electric heater 41 is controlled such that the canister temperature TCAN becomes equal to the first specific temperature TCAN1. Thereafter, when the engine temperature rises, the canister temperature TCAN cannot be controlled to the first specific temperature TCAN1, and therefore energization of the electric heater 41 is controlled such that the canister temperature TCAN becomes equal to the second specific temperature TCAN2. Further, when the engine temperature further rises, energization of the electric heater 41 is controlled such that the canister temperature TCAN becomes equal to the third specific temperature TCAN3.

At the following step S3, it is determined whether or not the canister temperature TCAN fetched at the step SI is in the vicinity of one of the specific temperatures, e.g. at TCAN1 ±1° C., TCAN2 ±1° C or TCAN3 ±1° C. If the answer is negative (NO), the present program is immediately terminated.

Figure 4A:
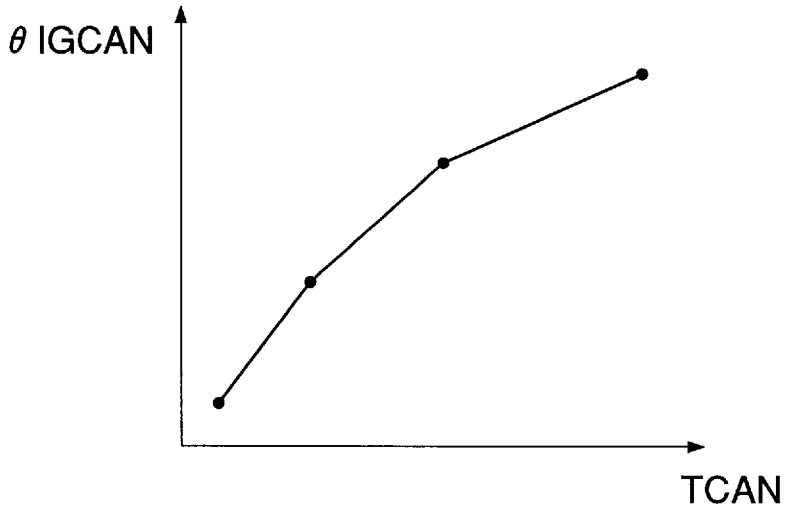
FIG. 4A shows a table for determining a correction term θ IGCAN used in the FIG. 2 processing.

On the other hand, if the answer is affirmative (YES), i.e. if the canister temperature TCAN is in the vicinity of one of the specific temperatures, the ignition timing θ IG and the EGR amount are corrected at steps S4 and S5, respectively. More specifically, at the step S4, a θ IGCAN table is retrieved according to the canister temperature TCAN to determine the correction term θ IGCAN employed in the above equation (2). The θ IGCAN table is set, as shown in FIG. 4A, such that the higher the canister temperature TCAN, the larger the correction term θ IGCAN, i.e. the larger the ignition timing advance value.

Figure 4B:
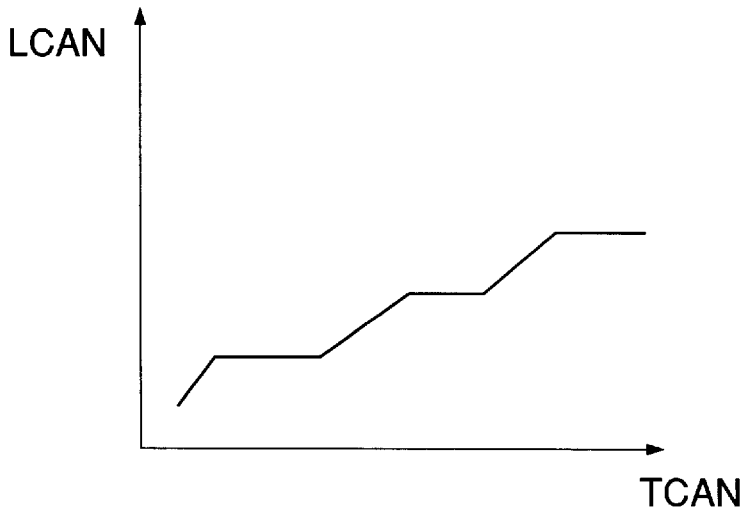
FIG. 4B shows a table for determining a correction term LCAN used in the FIG. 2 processing.

At the step S5, an LCAN is retrieved table according to the canister temperature TCAN to determine the correction term LCAN employed in the above equation (1). The LCAN table is set, as shown in FIG. 4B, such that the higher the canister temperature TCAN, the larger the correction term LCAN, i.e. the larger the EGR amount.

Figure 5A:
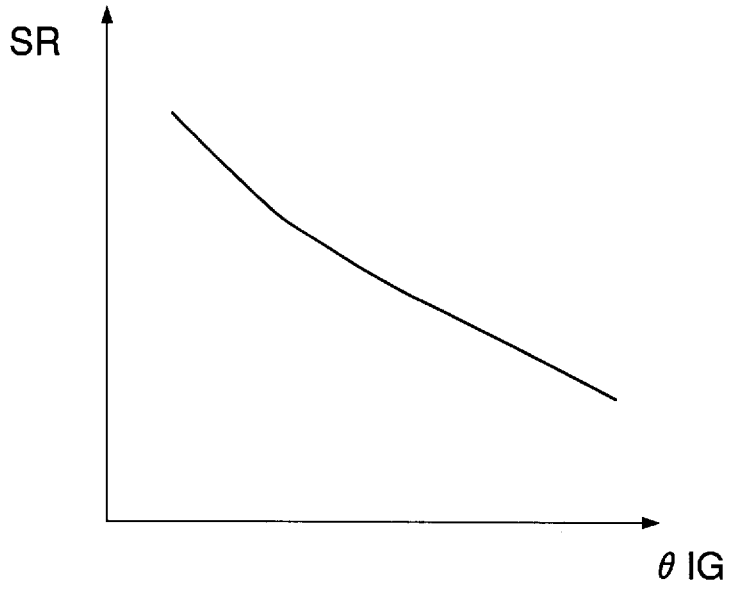
FIG. 5A shows a table for determining an SR (specific reactivity) value according to the ignition timing θ IG.
Figure 5B:
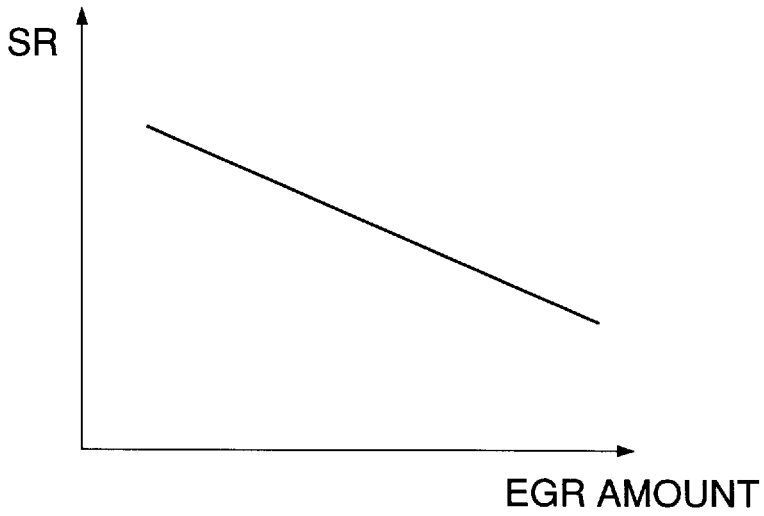
FIG. 5B shows a table for determining the SR value according to the amount of exhaust gases to be recirculated.

FIG. 5A shows the relationship between the ignition timing θ IG and an SR value (Specific Reactivity: grams of ozone produced for each gram of NMOG emitted by the engine), and FIG. 5B shows the relationship between the EGR amount and the SR value. As is clear in FIGS. 5A and 5B, the more advanced the ignition timing θ IG and/or the more increased the EGR amount, the more decreased the SR value.

Therefore, according to the processing of FIG. 2, if the canister temperature TCAN is in the vicinity of one of the specific temperatures at which a component having a high MIR value easily evaporates, the ignition timing is corrected in the direction of advancing the same and the EGR amount is increased, based on the canister temperature TCAN. As a result, the SR value can be decreased, to thereby reduce the amount of emission of HC compounds which are likely to produce ozone.

According to the above described embodiment, the ignition timing θ IG and the EGR amount are both corrected according to the canister temperature TCAN, but this is not limitative. Alternatively, one of the correction of the ignition timing θ IG or that of the EGR amount may be carried out. Further alternatively, the canister temperature control by the electric heater 41 may be omitted.

As described hereinabove, according to the invention, engine control parameters are changed according to detected canister temperature, and as a result, an amount of emission of HC compounds which are likely to produce ozone can be reduced.

What is claimed is:

1. A control system for an internal combustion engine having an intake system, a fuel tank, a canister for adsorbing evaporative fuel generated in said fuel tank, a purging passage extending between said canister and said intake system, for purging evaporative fuel into said intake system, and a purge control valve arranged across said purging passage, for controlling a flow rate of evaporative fuel supplied to said intake system through said purging passage;

the control system comprising:

engine control means for controlling said engine, based on at least one predetermined engine control parameter;

canister temperature-detecting means for detecting temperature of said canister; and parameter-changing means for changing said at least one predetermined engine control parameter according to the temperature of said canister detected by said canister temperature-detecting means.

2. A control system as claimed in claim 1, wherein said at least one predetermined engine control parameter includes a control amount of ignition timing of said engine.

3. A control system as claimed in claim 2, wherein said parameter-changing means advances the ignition timing of said engine as the temperature of said canister detected by said canister temperature-dectecting means is higher.

4. A control system as claimed in claim 1, wherein said at least one predetermined engine control parameter includes an amount of exhaust gases to be recirculated.

5. A control system as claimed in claim 4, wherein said parameter-changing means increases the amount of exhaust gases to be recirculated as the temperature of said canister detected by said canister temperature-detecting means is higher.

6. A control system for an internal combustion engine having an intake system, a fuel tank, a canister for adsorbing evaporative fuel generated in said fuel tank, a purging passage extending between said canister and said intake system, for purging evaporative fuel into said intake system, and a purge control valve arranged across said purging passage, for controlling a flow rate of evaporative fuel supplied to said intake system through said purging passage;

the control system comprising:

engine control means for controlling said engine, based on at least one predetermined engine control parameter;

canister temperature-detecting means for detecting temperature of said canister;

canister heater means for heating said canister;

canister temperature control means for controlling said heater means such that the temperature of said canister assumes at least one specific temperature value, according to the temperature of said canister detected by said canister temperature-detecting means; and parameter-changing means for changing said at least one predetermined engine control parameter according to the temperature of said canister controlled by said canister temperature control means.

7. A control system as claimed in claim 6, wherein said at least one predetermined engine control parameter includes a control amount of ignition timing of said engine.

8. A control system as claimed in claim 6, wherein said parameter-changing means advances the ignition timing of said engine as the temperature of said canister detected by said canister temperature-detecting means is higher.

9. A control system as claimed in claim 6, wherein said at least one predetermined engine control parameter includes an amount of exhaust gases to be recirculated.

10. A control system as claimed in claim 9, wherein said parameter-changing means increases the amount of exhaust gases to be recirculated as the temperature of said canister detected by said canister temperature-detecting means is higher.

11. A control system as claimed in claim 6, wherein said at least one specific temperature value is a temperature value at which a ratio of at least one specific HC compound in said evaporative fuel becomes high, said at least one specific HC compound being likely to produce ozone.

* * * * *